US005673607A

United States Patent [19]

Schwab

[11] Patent Number: 5,673,607

[45] Date of Patent: Oct. 7, 1997

[54] ROLLING HEAD DIAPHRAGM

[75] Inventor: Charles G. Schwab, Nashua, N.H.

[73] Assignee: Diacom Corporation, Amherst, N.H.

[21] Appl. No.: 543,868

[22] Filed: Oct. 19, 1995

[51] Int. Cl.[6] ..... F01B 19/00

[52] U.S. Cl. ..... 92/98 D; 92/103 R; 92/103 F

[58] Field of Search ..... 92/98 D, 103 R, 92/103 F

[56] References Cited

U.S. PATENT DOCUMENTS

| | | | |
|---|---|---|---|
| 2,692,618 | 10/1954 | Ludowici | 92/98 D |
| 2,733,572 | 2/1956 | Butterfield et al. | 92/98 D |
| 3,203,186 | 8/1965 | Shepard | 92/98 D |
| 3,969,991 | 7/1976 | Comstock et al. | 92/99 |
| 4,834,088 | 5/1989 | Jeanson | 188/299 |
| 5,154,204 | 10/1992 | Hatzikazakis | 137/203 |
| 5,155,997 | 10/1992 | McGushion | 92/98 D |
| 5,255,711 | 10/1993 | Reeds | 137/505.41 |
| 5,452,993 | 9/1995 | Lanigan | 417/413.1 |

OTHER PUBLICATIONS

Bellofram Catalog Expert pp. 1 & 21.

*Primary Examiner*—Thomas E. Denion
*Attorney, Agent, or Firm*—Vernon C. Maine

[57] ABSTRACT

A rolling head diaphragm and dome-shaped piston configuration where the geometry of the diaphragm and piston, and the length of stroke, are modified to enable the commonly known rolling wall action of rolling wall diaphragms to be extended into the center section of the diaphragm up over the piston head when it is at the lower end of it's stroke, thus eliminating the right angle of the head/wall juncture of common pistons and the tight radius of the head/wall shoulder molded into other diaphragms, thereby extending the maximum available stroke and improving diaphragm reliability and longevity.

3 Claims, 5 Drawing Sheets

ROLLING HEAD DIAPHRAGM

BACKGROUND OF THE INVENTION

1. Technical Field of the Invention

This invention most generally relates to expandible chamber devices.

More particularly, this invention relates to the use of a rolling wall diaphragm to contain and direct the force of a fluid or gas under pressure upon the head of a movable piston.

2. Background Art

Piston/cylinder assemblies have been commonly employed for decades to convert fluid or gas pressure into mechanical motion and vice versa. In it's simplest form, a piston is a closely confined but longitudinally movable plug within a cylinder. Fluid or gas is admitted under pressure into the upper chamber between the piston and the cylinder head. The fluid or gas, being otherwise confined by the cylinder head and walls, pushes the piston down or away from the cylinder head, or conversely pulls the piston up or towards the cylinder head if the pressure is negative. A connecting rod pinned or fastened to the underside of the piston directs the mechanical output to the desired mechanism for the particular application. The device may be operated in reverse to use mechanical motion to compress or pump a fluid or gas.

Sealing the fluid or gas within the upper chamber of the cylinder is necessary to maintain the pressure differential above and below the piston, avoid the leakage out of or into the compression chamber between the piston and cylinder wall. A sliding seal such as the piston wall or a piston ring on the piston wall, may be sized to fit closely or lightly contact the cylinder wall, and thereby provide a sufficient seal for many applications. However, rings are subject to friction, heat, wear, and lubrication requirements, and the porosity of the cylinder wall-acts as a transfer cavity as the piston ring passes back and forth over it, continually leaking materials into and out of the compression chamber.

Rolling wall diaphragms were developed to provide an effective seal for the compression chamber, and have been long employed in virtually every major industry from automotive and aerospace to medical devices and food processing to waste water treatment machinery. The flexible, rolling wall diaphragm is typically fabricated on a top hat-shaped form with a fabric base over which is applied an elastomer. It is then inverted for installation in a piston/cylinder assembly.

An involuted, rolling wall diaphragm is typically arranged with it's outer flange clamped to a circular flat surface adjoining and normal to the wall of the cylinder, the inner diameter of the diaphragm flange protruding into the cylinder and transitioning into a tubular or columnar shape embracing the piston, transitioning then at a molded-in relatively tight right angle to it's flat center section which lies on the top of a conventional flat head piston. The flat center section may be clamped to the piston head in some arrangements.

The diaphragm's rolling wall function is accomplished within the uniform space between the cylinder and piston walls, where diaphragm spans the gap between the cylinder and piston walls with a rolling fold. This fold of diaphragm material skirts the piston and is rolled upward and downward by the action of the piston and the pressure differential on the diaphragm.

Comstock's U.S. Pat. No. 3,969,991 disclosed means for reducing the phenomena known as cusping, where the linear variation in the diaphragm's diameter intended to span the gap between the cylinder radius and the piston radius resulted in excess material which under pressure on a compression stroke could collapse into folds or pleats against the piston wall, greatly reducing the life of the diaphragm. Comstock incorporated a relatively large radius into the diaphragm's cross-sectional shape, beginning at the point equal to the cylinder diameter, to more effectively distribute the pressure and flexure on the rolling wall at the juncture with the cylinder wall, and to conform the diaphragm more closely to the piston profile when the cylinder was in the fully compressed configuration.

A problem not addressed by the prior art is evident at another point on the diaphragm. If set up for maximum stroke or piston travel, the right angle structure of the diaphragm at the intersection of the cylinder wall and the top edge of the piston would be flexed or bent 180 degrees from lying against the piston wall to fully 90 degrees up from the plane of the top of the piston when the piston is in the lower-most position, and then reflexed 180 degrees down again as the piston begins it's upward stroke.

This concentrated area of stress and small radius flexure is an inherent weak point in conventional designs, and piston stroke is therefore generally limited to advancing the rolling wall to something less than the full length of the diaphragm, to avoid the problem of the reversing flexure.

SUMMARY OF THE INVENTION

The invention in it's simplest form is a piston with a dome-shaped head and a conforming, rolling wall diaphragm. The shape of the piston head forms a functional extension of the piston wall that makes additional diaphragm surface area available as effective rolling wall or rolling head length, thereby allowing a relatively longer stroke of the piston between compressed and extended limits of piston travel.

The new shape of the diaphragm also eliminates the relatively sharp corner molded into the diaphragms of the prior art in favor of terminating with a uniformally large radius, and distributes the stress of repeated reversing flexures at the piston wall and head juncture of the prior art into a much larger, more uniform final radius, thereby extending the life of the diaphragm.

It is an object of the invention to provide a diaphragm with an extended rolling wall capability for greater length of stroke potential than prior art diaphragms having planar center sections normal to the axis of operation.

It is another object of the invention to provide a piston with an extended rolling wall capability for greater length of stroke potential than prior art pistons having planar heads normal to the axis of operation.

It is yet another object of the invention to reduce the difficulty in manufacture of rolling wall diaphragms associated with the tight radius needed to conform to the head/wall juncture of prior art pistons.

It is still yet another object to reduce in rolling wall diaphragms the stress and potential of rupture or failure associated with the tight radius of this molded corner.

Still other objects and advantages of the present invention will become readily apparent to those skilled in this art from the following detailed description, wherein I have shown and described preferred and other embodiments of the invention, simply by way of illustration of the best mode contemplated by me on carrying out my invention.

As will be realized, the invention is capable of other and different embodiments, and its several details are capable of modifications in various obvious respects, all without departing from the invention.

DESCRIPTION OF THE PREFERRED EMBODIMENT

Figure 1:
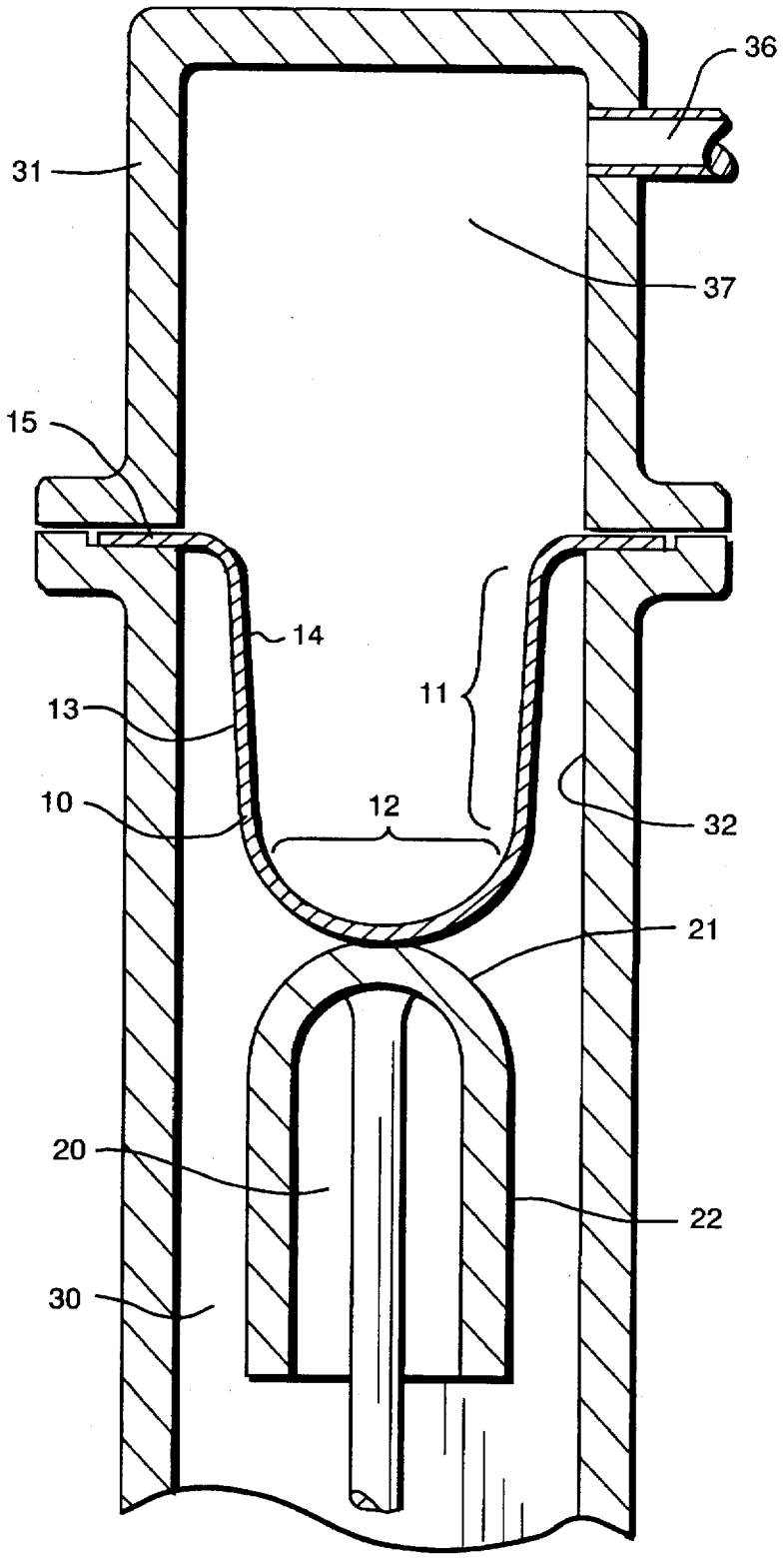
FIG. 1 is a cross section perspective of a preferred embodiment of the invention, with the piston in the extended position.

There are numerous variations in the form of the invention, such as are illustrated and described herein, which fall within the scope of the appended claims.

For example, a diaphragm of the invention may include a means for circumferential attachment to the wall of the cylinder, with an elongated columnar section extending axially from the point of attachment away from the cylinder head, and having a semi-spherical or bowl-shaped center section concluding at a centerpoint on the operating axis of the cylinder and piston.

As another example, a piston is sized so that it's diameter is enough smaller than the diameter of the cylinder that there is room between the cylinder wall and the piston wall for the typical rolling wall action of the diaphragm to transpire.

The piston has a round or dome-shaped piston head that extends upward from the circular piston wall or skirt so that the diaphragm is invaginated or turned inside out and disposed uniformally over the piston head and piston when the piston is in the compressed position at the top of the stroke, nearest the cylinder head.

A circumferential rolling wall action occurs when the piston is forced downward by sufficient pressure in the cylinder. The rolling wall consumes the columnar section of the diaphragm, progressing up the wall of the piston, and transitions into the center section of the diaphragm up over the head of the piston to the centerpoint of the diaphragm.

As yet another example of the invention, the diaphragm may be attached to the cylinder wall by a clamping flange configured about it's circumference, normal to the axis of the cylinder, which is clamped in a mounting slot in the cylinder wall or between the top of the cylinder wall and the cylinder head, or by any other known or novel means.

As still yet another example, the diaphragm may be fastened at it's centerpoint to the piston, with the stroke of the piston limited so that the rolling wall action cannot reach and affect stress on the diaphragm at the point of attachment.

As even still yet another example, the diaphragm of the invention may be constructed with a fabric layer or layers which are coated with an elastomer layer or layers. The fabric layers may of a polyester weave, and be laid up over a mold, with the elastomer then applied.

As an additional example, such a diaphragm and piston may work in combination.

As another additional example, such a diaphragm and piston may work in conjunction with a pressure head, without need for a cylinder wall if the diaphragm is strong enough to withstand the working pressure of the assembly without additional support, where the diaphragm has a means for being attached to the pressure head, a circular exterior section protruding in the direction of the piston, and a semi-spherical or bowl-shaped center section that terminates in a centerpoint.

The piston would have a skirt or piston wall that extends upward into a rounded or dome-shaped piston head of the same radius as the top of the piston wall or skirt.

The circumferential rolling wall action would transpire in the same manner as previously described.

Figure 2:
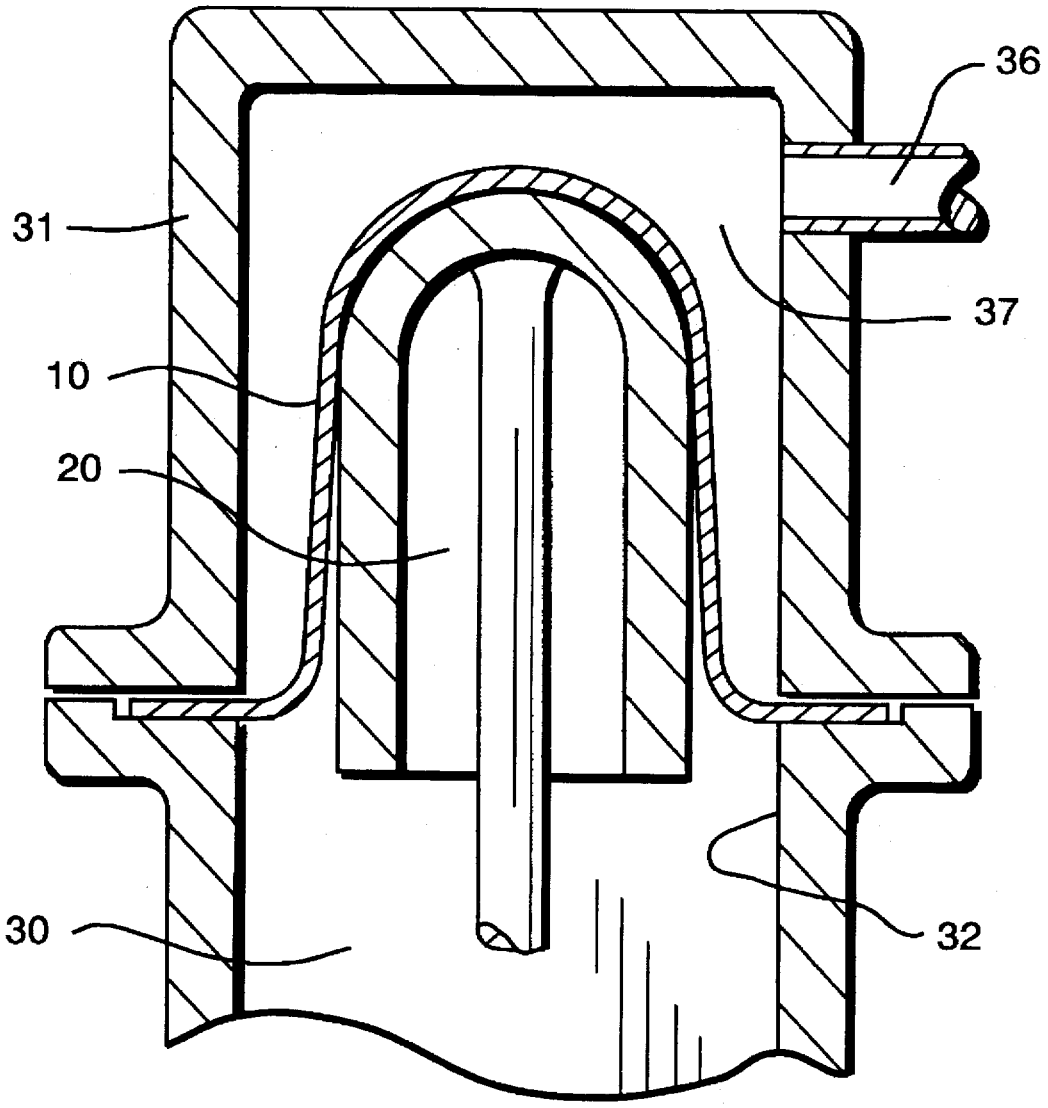
FIG. 2 is the cross section perspective of FIG. 1, with the piston in the compressed position.
Figure 3:
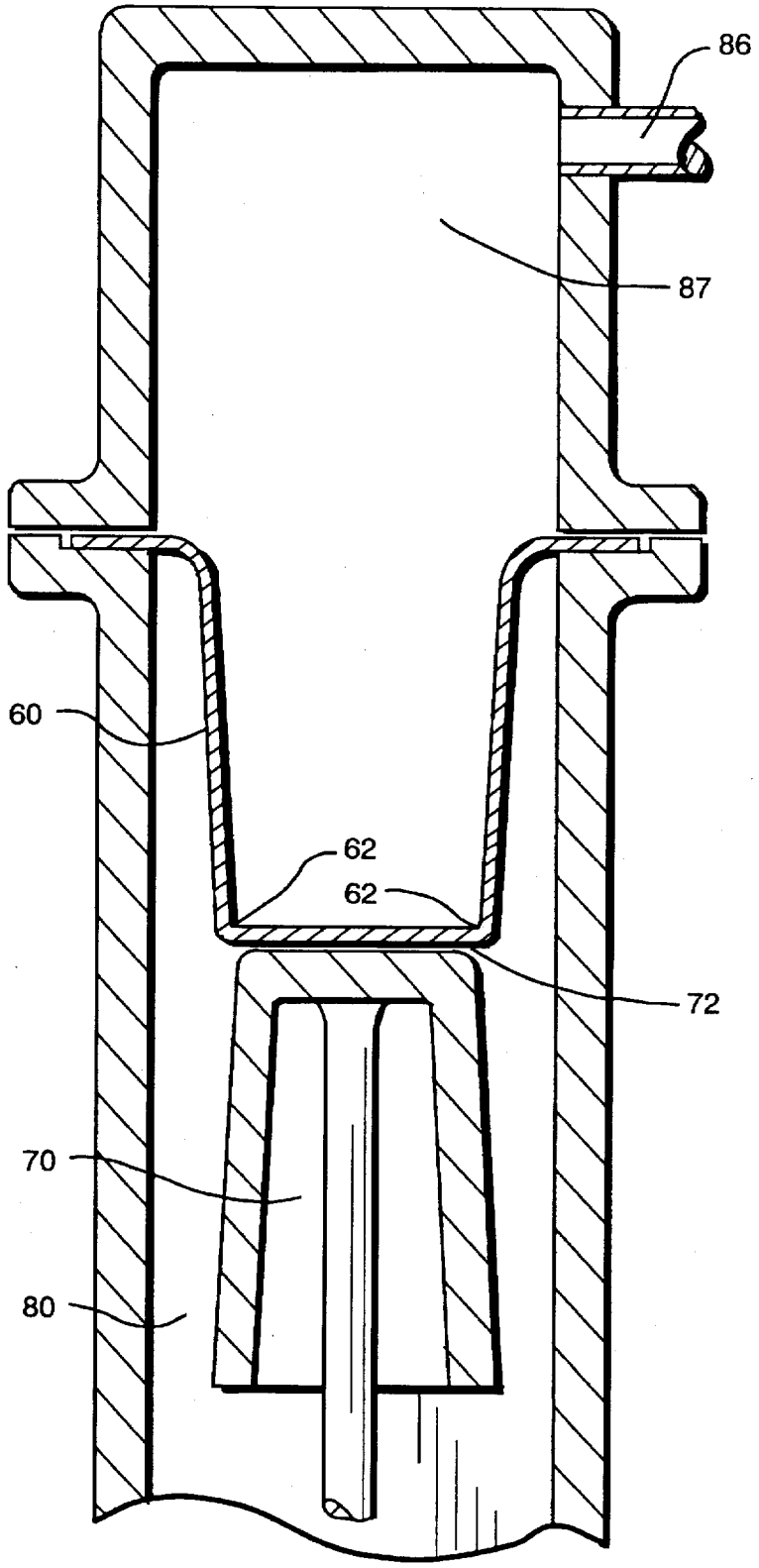
FIG. 3 (PRIOR ART)
FIG. 3 is a cross section perspective of the prior art equivalent of FIG. 1.
Figure 4:
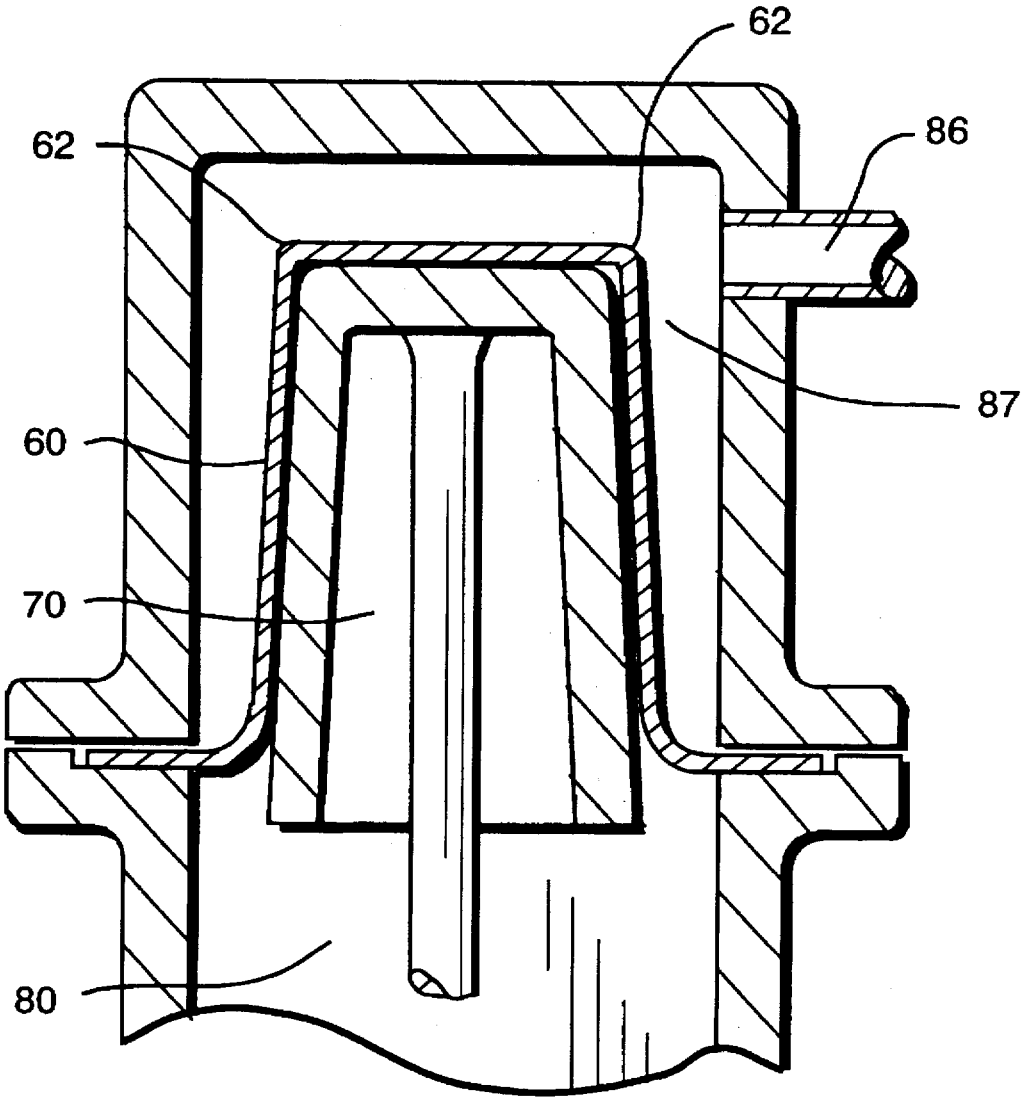
FIG. 4 (PRIOR ART)
FIG. 4 is the cross section perspective of prior art FIG. 3, with the piston in the compressed position.

FIGS. 1 and 2 illustrate the preferred embodiment as a full form involuted, rolling head diaphragm 10 molded to fit a dome-shaped piston 20 operating within cylinder 30 which includes cylinder head 31, operated by pressurized fluid, air or gases admitted through port 36 into pressure chamber 37. A comparatively dimensioned prior art diaphragm 60, piston 70 and cylinder 80 with port 86 and chamber 87, are illustrated in FIGS. 3 and 4.

Referring to FIGS. 1 and 2, diaphragm 10 is of conventional construction with fabric backing 13 of a polyester weave and coated with an elastomer layer 14. It is constructed in the form of a roundtop hat as is evident in FIGS. 1 and 2, with a clamping flange 15, columnar section 11 and semi-spherical or bowl-shaped center section 12, and is easily distinguishable from the flattop hat shape of prior art diaphragm 60 of FIGS. 3 and 4 with it's sharp corner 62 molded in to fit the wall/head juncture 72 of flattop piston 70.

Figure 5B:
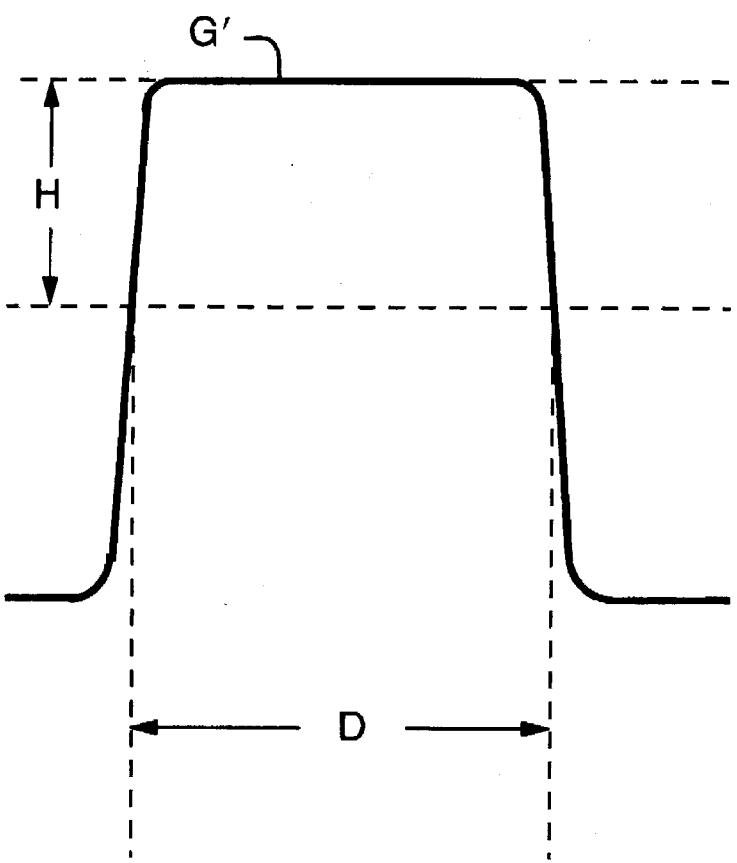
FIG. 5 illustrates comparitive generatrix sections for the diaphram of the invention as to the diaphragm of the prior art.
Figure 5A:
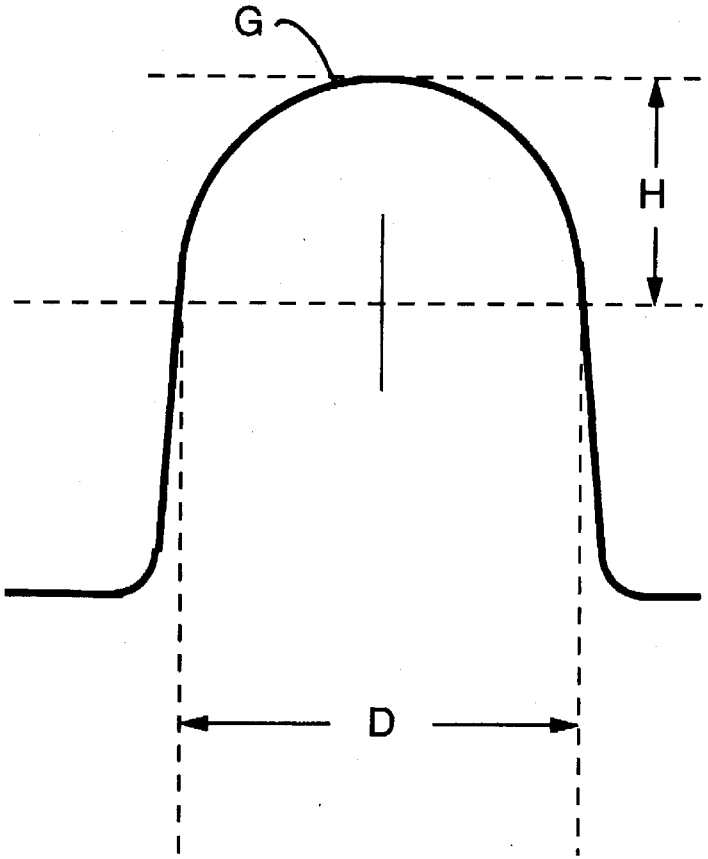

Referring to FIG. 5, comparing generatrix G for height H of 25 the partial cross section of diaphragm 10 to generatrix G' for the same height H of the partial cross section of diaphragm 60, where each has diameter D, it is readily apparent that generatrix G=#/2×D, while generatrix G'=2D', and that G<G'.

Conversely, it is readily apparent from FIG. 5 that for diaphragms of equal diameter, and with generatrices of equal length, the resulting maximum height or length of stroke of diaphragm 10 is greater that that of prior art diaphragm 60.

Referring to FIGS. 1 and 2 in sequence, in operation the positive pressure in chamber 37 is relaxed sufficiently that piston 20 moves upward from the fully extended position of FIG. 1 to the fully compressed position of FIG. 2, relative to cylinder head 31.

During this upward motion of piston 20, diaphragm 10 is invaginated or collapsed beginning at the centerpoint of diaphragm center section 12 and supported by the rising piston, the size of the supported area bounded by a circumferential rolling wall progressing smoothly outward over head 21 with a typical rolling wall action as piston 20 rises, gradually inverting the inflated center section 12 of diaphragm 10. The rolling wall action in this case could be described a rolling head action.

The unsupported portion of columnar section 11 of diaphragm 10 between diaphragm flange 15 and piston 20 is kept inflated within the space between piston 20 and cylinder wall 32 by the pressure within chamber 37, allowing piston 20 to progress uniformly without snagging on unsupported columnar wall 10 material.

The rolling wall action transitions smoothly from head 21 to the wall 22 of piston 20, gradually consuming the unsupported columnar wall 11 of diaphragm 10, and enveloping the full length of piston 20.

Referring now to FIGS. 2 and 1 in sequence, when the pressure in chamber 37 is increased sufficiently to overcome the upward force on piston 20, diaphragm 10 inflates, pushing piston 20 downward from the position of FIG. 2 towards the position of FIG. 1. Columnar wall 11 peels with rolling wall action off descending piston wall 22, the rolling wall action transitioning inward as rolling head action to center section 12 and over head 22 as diaphragm 10 inflates under pressure and pushes piston 20 downward.

It will be readily apparent to those skilled in the art that the effective compression ratio of the device of FIGS. 1 and 2 is decreased proportionally with the effective surface area of piston 20 as the diaphragm center section 12 rolls up over piston head 22, and vice versa, introducing a non-linear element to the operating characteristics of the assembly and limiting the range of applications to where surplus working pressure is available at the lower end of the stroke.

It will be further apparent to those skilled in the art that cylinder wall 32 outboard of pressure chamber 37 may be configured as other than non-porous or airtight when used with a diaphragm, or simply eliminated in those cases where diaphragm 10 is strong enough to withstand the full working pressure. Cylinder head 31 would function in those cases simply as a pressure head, providing the same general functions but without an extending cylinder wall, and diaphragm 10 and piston 20 would function as otherwise described.

The objects and advantages of the invention may be further realized and attained by means of the instrumentalities and combinations particularly pointed out in the appended claims. Accordingly, the drawings and description are to be regarded as illustrative in nature, and not as restrictive.

I claim:

1. A cylinder, piston and rolling wall diaphragm in combination, comprising:

said cylinder having an interior wall and means for circumferential attachment of said diaphragm thereto, said diaphragm being attached by said means to said interior wall and having a columnar section reducing in size from the circumference of said interior wall to the circumference of said piston, said columnar section transitioning into a bowl-shaped center section;

said piston having a piston wall of diameter sufficiently smaller than the diameter of said cylinder to accommodate a rolling wall action in said diaphragm, said piston wall transitioning into a dome-shaped piston head conforming to the shape of said center section of said diaphragm, said piston configured within said cylinder to have a maximum extended position of said piston head relative to said means of circumferential attachment of greater than the length of said columnar section and not greater than the sum of the lengths of said columnar section and said piston head.

2. The combination of claim 1, wherein said means for circumferential attachment comprises a circumferential clamping flange extending outward from said columnar section whereby a cylinder head is secured to said cylinder with said clamping flange disposed there between.

3. The combination of claim 1, wherein said diaphragm is constructed of a fabric layer coated with an elastomer layer.

* * * * *